US009655437B2

(12) United States Patent
Clause et al.

(10) Patent No.: US 9,655,437 B2
(45) Date of Patent: May 23, 2017

(54) MULTIPURPOSE PORTABLE TABLE

(71) Applicant: Tabletop Gear, LLC, Tampa, FL (US)

(72) Inventors: Charles Curtis Clause, Plant City, FL (US); David Michael Flores, Temple Terrace, FL (US)

(73) Assignee: Tabletop Gear, LLC, Tampa, FL (US)

( * ) Notice: Subject to any disclaimer, the term of this patent is extended or adjusted under 35 U.S.C. 154(b) by 0 days.

(21) Appl. No.: 15/235,301

(22) Filed: Aug. 12, 2016

(65) Prior Publication Data

US 2017/0042321 A1 Feb. 16, 2017

Related U.S. Application Data

(60) Provisional application No. 62/205,317, filed on Aug. 14, 2015.

(51) Int. Cl.

| | |
|---|---|
| ***A47B 85/00*** | (2006.01) |
| ***A47B 3/06*** | (2006.01) |
| ***A47B 13/02*** | (2006.01) |
| ***A47B 13/00*** | (2006.01) |
| ***A47B 13/16*** | (2006.01) |

(52) U.S. Cl.

CPC ..... *A47B 3/06* (2013.01); *A47B 13/003* (2013.01); *A47B 13/023* (2013.01); *A47B 13/16* (2013.01); *A47B 2013/006* (2013.01); *A47B 2013/024* (2013.01)

(58) Field of Classification Search

CPC ..... A47B 13/16; A47B 13/02; A47B 13/023; A47B 2200/03; A47B 2200/0021; A47B 37/04; A47B 2013/024; A47B 13/003; A47B 2013/022; A47G 25/0607

USPC ..... 108/25, 26, 150, 30, 50.12, 157.1, 108/159.11, 158.11

See application file for complete search history.

(56) References Cited

U.S. PATENT DOCUMENTS

| | | | | | |
|---|---|---|---|---|---|
| 103,387 | A * | 5/1870 | Sutton | A47B 61/00 | 108/30 |
| 117,044 | A * | 7/1871 | Caple | A47B 13/16 | 108/139 |
| 685,074 | A * | 10/1901 | Wiehl | B67D 1/0004 | 108/25 |
| 1,712,389 | A * | 5/1929 | Marchant | A47B 49/00 | 108/30 |
| 2,306,938 | A * | 12/1942 | Ebbert | A47F 5/025 | 108/21 |
| 2,980,261 | A * | 4/1961 | Young, Jr. | A47F 5/02 | 108/139 |
| 3,139,189 | A * | 6/1964 | Kolarik | A47F 5/02 | 108/103 |
| 3,215,095 | A * | 11/1965 | Keppeler | A45B 3/00 | 108/50.12 |

(Continued)

*Primary Examiner* — Jose V Chen

(74) *Attorney, Agent, or Firm* — Shumaker, Loop & Kendrick, LLP

(57) ABSTRACT

Disclosed is a portable table assembly having a table top, a hollow cylindrical stem that receives the table top, and a removable securing end cap that secures the table top to the cylindrical stem. The portable table assembly is easily assembled and adaptable for a wide variety of uses including, but not limited to, patio/porch use, outdoor/lawn gaming, parks and general recreation, outdoor sporting and concert events, tailgate parties, camping, gardening, beach use (with or without a beach umbrella), and boating.

9 Claims, 12 Drawing Sheets

(56) References Cited

U.S. PATENT DOCUMENTS

| | | | | |
|---|---|---|---|---|
| 6,705,240 | B2 * | 3/2004 | Block | A47B 37/04 108/150 |
| 7,207,450 | B1 * | 4/2007 | Franklin | A45F 3/44 108/25 |
| 8,464,646 | B1 * | 6/2013 | Schiller | A47B 37/04 108/50.12 |
| 8,640,894 | B1 * | 2/2014 | Cronin | A47B 97/00 108/183 |
| 2004/0129184 | A1 * | 7/2004 | Kraker | A45B 25/00 108/50.12 |
| 2014/0102337 | A1 * | 4/2014 | Ralph | A47B 37/04 108/25 |
| 2015/0068433 | A1 * | 3/2015 | Nardi | A47B 13/16 108/25 |
| 2015/0208634 | A1 * | 7/2015 | Box | A01K 97/10 108/25 |

* cited by examiner

MULTIPURPOSE PORTABLE TABLE

CROSS REFERENCE TO RELATED APPLICATIONS

This U.S. Non-Provisional Patent Application claims priority from U.S. Provisional Patent Application No. 62/205,317 filed Aug. 14, 2015, which is incorporated herein in its entirety.

TECHNICAL FIELD

The present invention relates generally to the field of tables, and more particularly, to multipurpose portable tables that are easily assembled and disassembled and that can be placed onto or through a plurality of bases.

BACKGROUND

Current tables and table tops are restricted to either indoor or outdoor uses and have very little versatility. For example, certain existing tables and table tops have restricted portability due to their size and/or weight. Most of the currently existing portable table tops have permanently attached, collapsible/foldable legs, but are incapable of being disassembled for transport purposes. Furthermore, many of these portable table tops are not readily adaptable for different activities including, but not limited to, patio/porch use, outdoor/lawn gaming, parks and general recreation, outdoor sporting and concert events, tailgate parties, camping, gardening, beach use (with or without a beach umbrella), and boating.

Therefore a need exists to provide a table that overcomes the limitations of the above mentioned portable tables and table tops and that allows for an entire variety of uses including at least, but not limited to, patio/porch use, outdoor/lawn gaming, parks and general recreation, outdoor sporting and concert events, tailgate parties, camping, gardening, beach use (with or without a beach umbrella), and boating.

SUMMARY

Disclosed herein are tables and table assemblies that overcome the limitations known in the art, allowing for a wide variety of uses including at least, but not limited to, patio/porch use, outdoor/lawn gaming, parks and general recreation, outdoor sporting and concert events, tailgate parties, camping, gardening, beach use (with or without a beach umbrella), and boating. Specifically disclosed are portable tables and portable table assemblies including a hollow cylindrical stem; a table top having an opening in a middle of the table top that is adapted to receive the hollow cylindrical stem therethrough such that the hollow cylindrical stem extends above and below the table top when inserted in the opening; and a removable end cap that engages the cylindrical stem to secure the table top to the cylindrical stem.

In certain aspects, the hollow cylindrical stem has spaced apart ends with a first end configured to receive a base and a second end having an annular flange and externally threaded portions adjacent to and extending vertically above the annular flange such that the table top seats on the annular flange and the externally threaded portions of the second end extend above the table top when the threaded portions are received through the opening.

In certain aspects, the removable end cap is internally threaded and adapted to secure the table top between the annular flange and end cap by engaging the externally threaded portions of the second end of the hollow cylindrical stem such that the table top is compressed between the annular flange and cap as the cap is advanced along the externally threaded portions of the second end in a direction towards the annular flange, In certain aspects, the first end of the hollow cylindrical stem has a larger outer diameter than the second end of the hollow cylindrical stem.

In certain aspects, the portable table assembly further includes a detachable base configured for removable insertion in the first end of the hollow cylindrical stem.

In certain aspects, the detachable base comprises an annular flange on which the first end of the hollow cylindrical stem rotatably seats when the base is removably inserted in the first end of the hollow cylindrical stem.

In certain aspects, the portable assembly further includes a handle fixed to and extending above the table top.

In certain aspects, the portable assembly further includes a plurality of removable cupholders, each removable cupholder being received through an opening formed on the table top such that each cupholder extends above and below the table top when received through the opening formed on the table top.

In certain aspects, hooks are fixed to the hollow cylindrical stem between the first and second ends of the hollow cylindrical stem. For example, the hooks may be fixed mid-span of the hollow cylindrical stem along the longitudinal axis of the hollow cylindrical stem.

In certain aspects, the portable table assembly further includes a plurality of hooks attached to and extending below the table top such that each hook is offset from and positioned laterally adjacent to a corner of the table top.

In certain aspects, the portable table assembly further includes a plurality of knobs attached to and positioned above the table top, wherein at least one knob is axially aligned with at least one of the plurality of hooks attached to and extending below the table top.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which:

FIG. 10B depicts the threaded through coupling engaging the hollow cylindrical stem with the table top being secured there between.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
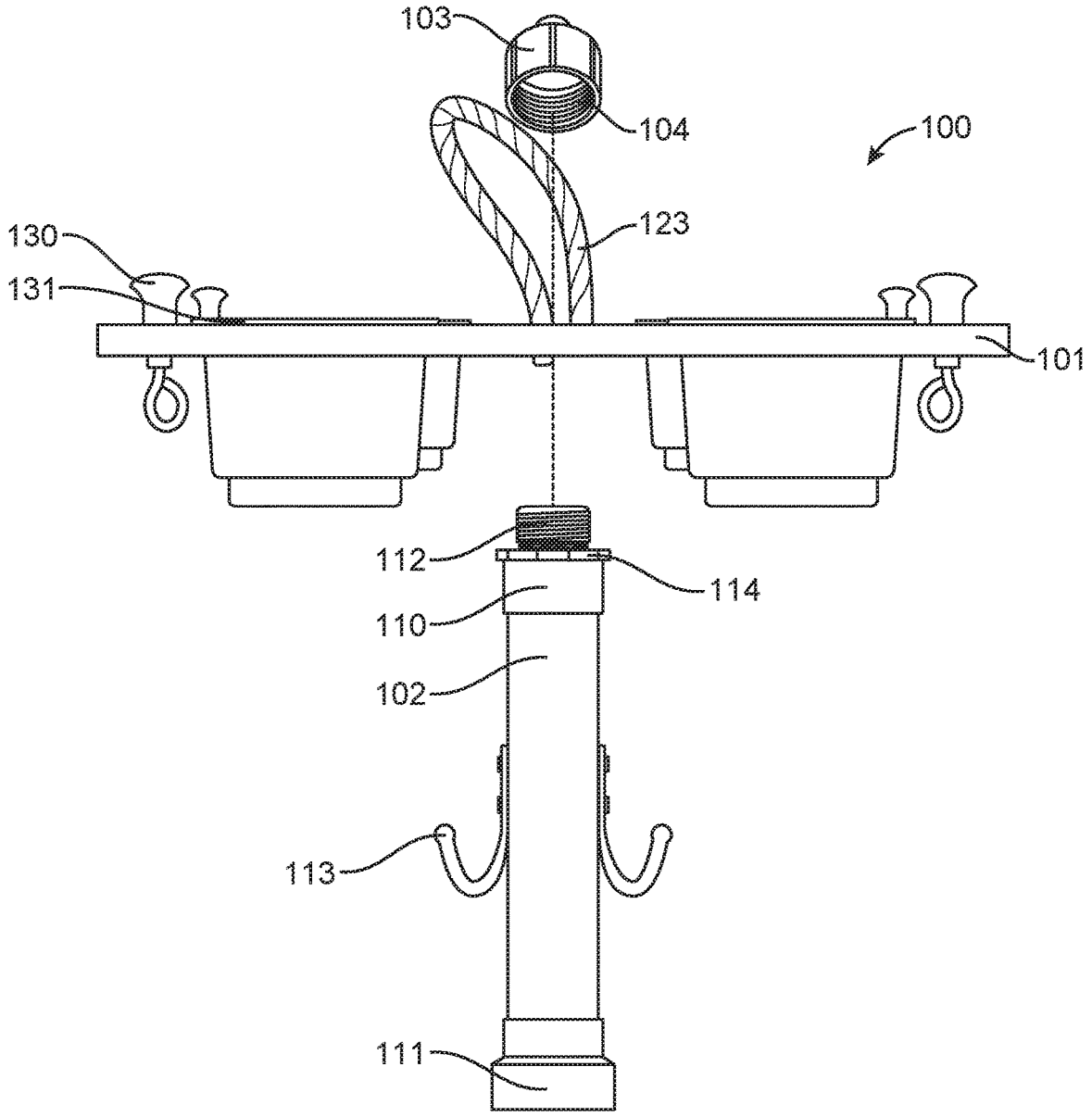
FIG. 1 is an exemplary view of the disassembled portable table assembly.
Figure 2:
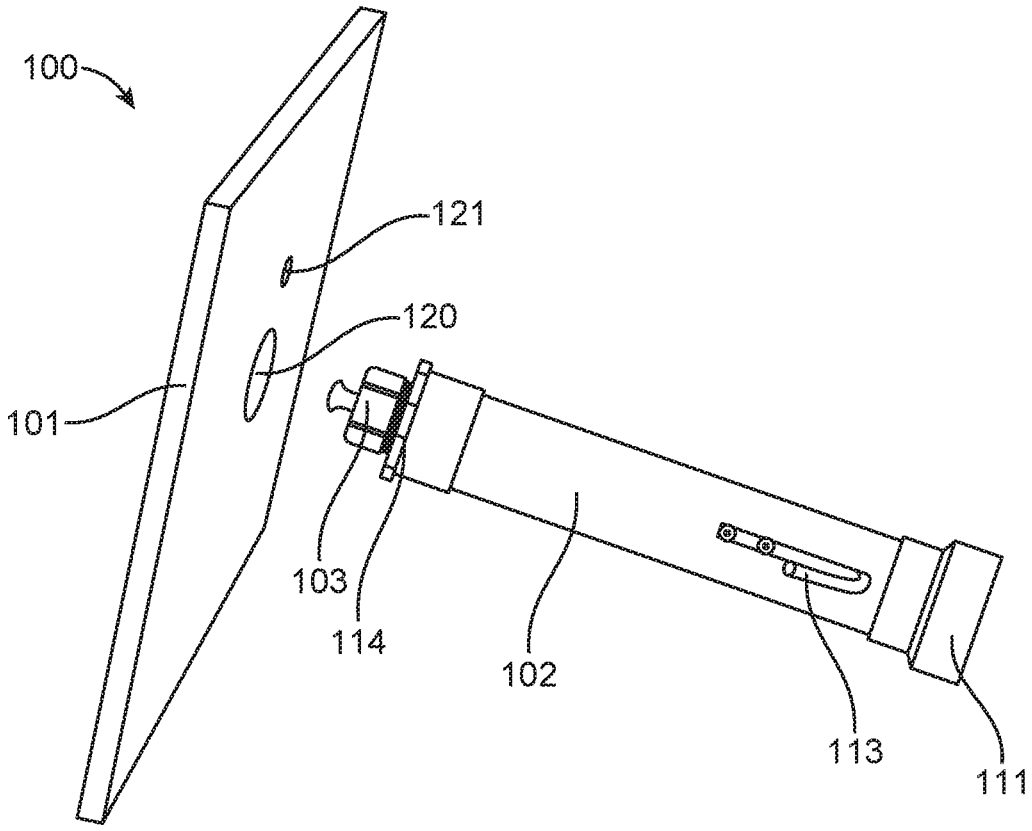
FIG. 2 is another exemplary view of the disassembled portable table assembly.

Disclosed is a portable table assembly 100 having a table top 101, a hollow cylindrical stem 102 that receives the table top, and a removable securing end cap 103 that secures the table top 101 to the hollow cylindrical stem 102. FIG. 1 depicts a partially exploded view of the portable table assembly 100 in which the securing end cap 103 has been removed and is not securing the table top 101 to the hollow cylindrical stem 102.

Figure 6A:
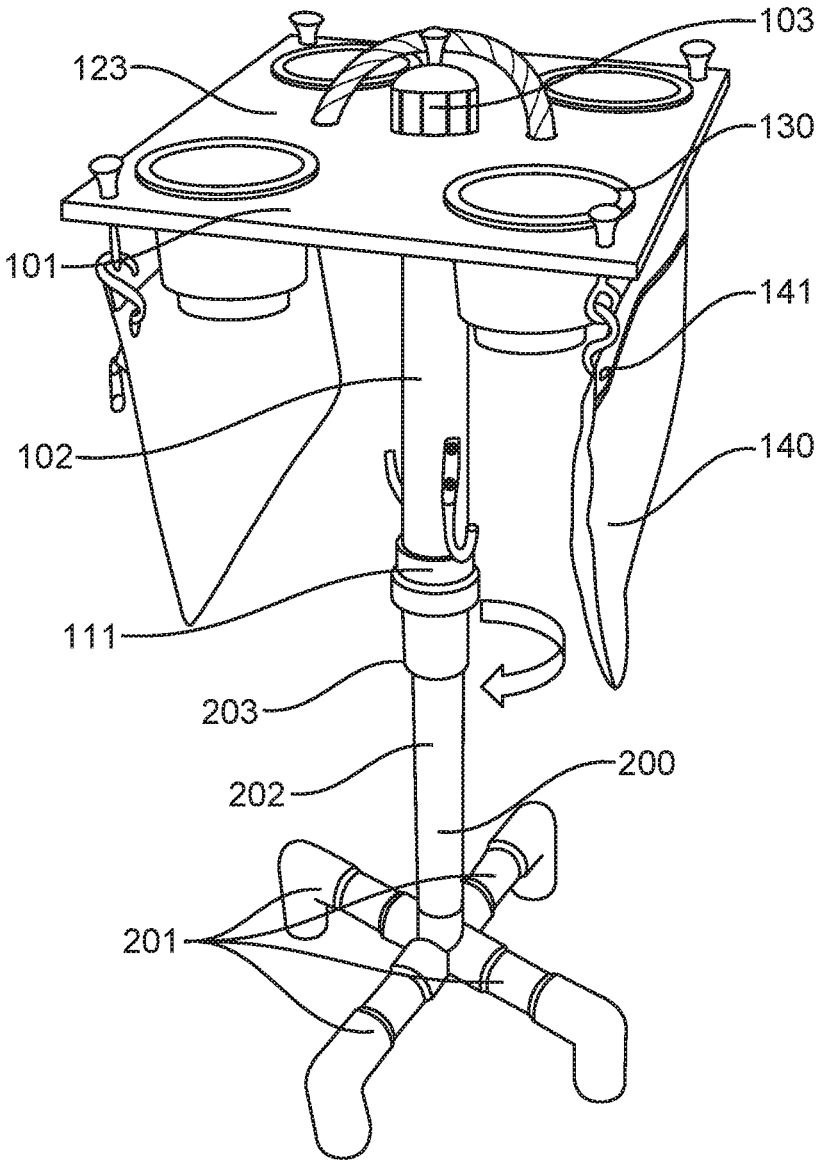
FIG. 6A is an environmental view of the assembled portable table assembly being placed on a base member, and FIG. 6B further depicts the exemplary base member of FIG. 6A.
Figure 6B:
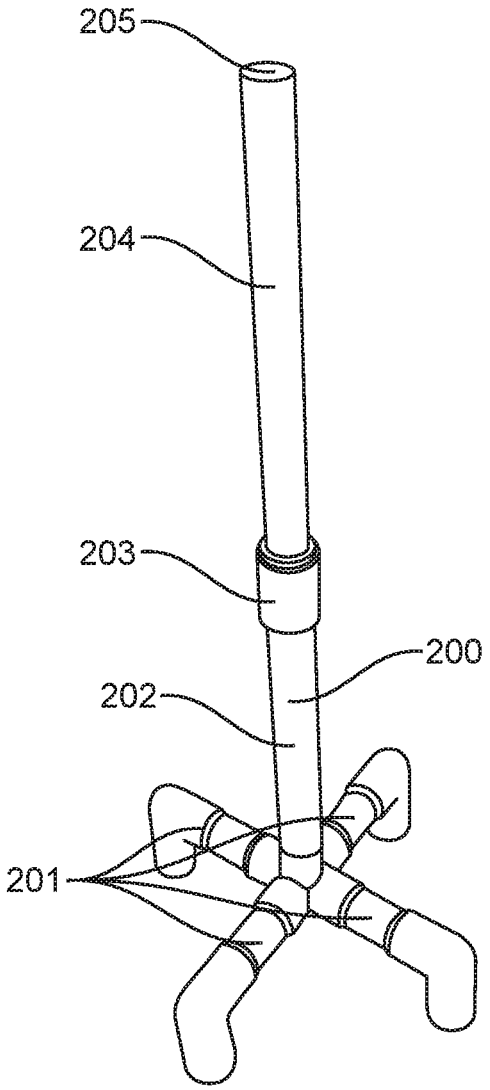

The hollow cylindrical stem 102 preferably has a first end portion 110 and a second end portion 111 positioned at opposite ends of the hollow cylindrical stem that are in fluid communication with one another due to the stem being hollow throughout its longitudinal axis. The first end portion 110 has a tapered inner and outer diameter relative to the remaining portions of the hollow cylindrical stem 102 and preferably includes annular flange 114 and a neck 112 at the first end portion 110. The neck 112 is adapted to extend through a first through hole (opening) 120 in the table top 101. The neck 112 is preferably adapted to secure the table top 101 to the stem 102 by engaging securing end cap 103 by a threaded engagement, snap fit engagement, a friction fit engagement, or any combination thereof to the neck 112. The second end portion 111 of the hollow cylindrical stem 102 preferably flares out thereby having a larger outer diameter and inner diameter when compared to all other portions of the hollow cylindrical stem thereby being adapted to engage, for example, a base member 200 as shown in FIGS. 6A and 6B. In certain aspects, the second end portion 111 may also be adapted for any one of a threaded engagement, snap fit engagement, or a friction fit engagement to a base member 200, 300, 400, or in alternative aspects, the second end portion 111 may be adapted to slip over or be placed (e.g., loosely fits over) on base member 200, 300, 400. In any of these aspects and as further shown in FIGS. 6A and 8, the table top 101 may preferably rotate about the base member such that a user may easily turn the table top as desired. The hollow cylindrical stem 102 may further include one or more utility hooks 113 positioned mid-span on the outer diameter of the cylindrical stem 102 for hanging articles (e.g., beach towels, clothing, horse shoe(s), corn hole bag(s), purse(s)/hand bag(s), etc.) therefrom.

The table top 101 has a predetermined shape, including but not limited to, a square shape, a rectangular shape, a circular shape, or a triangular shape having a first through hole 120 positioned at the midpoint of the table top. The first through hole 120 of the table top is configured to receive the neck 112 of the hollow cylindrical stem 102. Two additional through holes 121, 122 are positioned about a coplanar axis relative to the first through hole 120, with the first through hole 120 being positioned in between these two additional through holes 121, 122. These two additional through holes 121, 122 are configured to receive rope or another flexible and/or rigid material 123 capable of being passed there through thereby forming a handle 123 aiding in portability of the table top 101 and/or the entire table assembly 100 when fully assembled or disassembled.

In certain aspects, the table top 101 may further include one or more storage compartments 130 including, but not limited to, cup holders extending from a top surface of the table top to below a bottom surface of the table top 101. For example, FIGS. 1-6B depict a square shaped table top 101 having four storage compartments 130 positioned along its corners that are spaced equidistant relative to one another. In certain alternative embodiments, the number of storage compartments may be varied as desired, for example, none, one, two, or three storage compartments may be included positioned on the table top.

Figure 7:
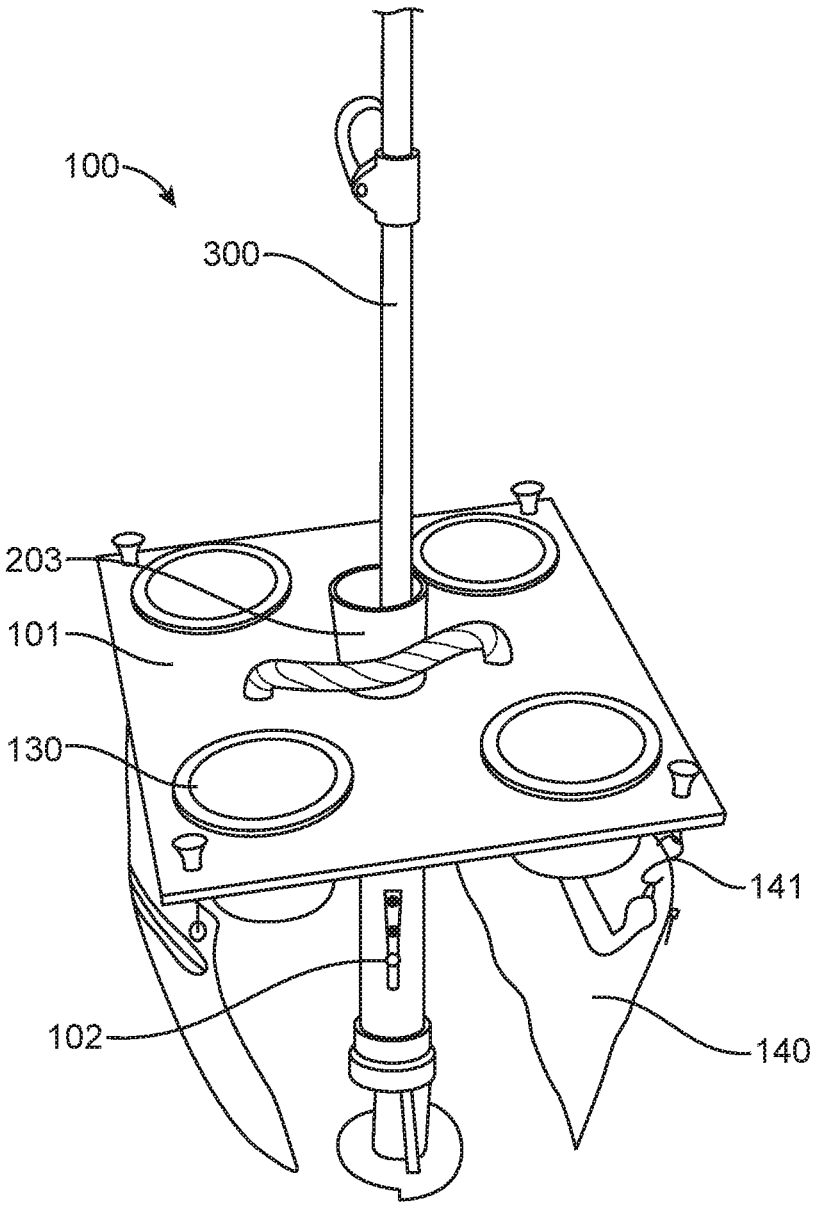
FIG. 7 is a second environmental view of the assembled portable table assembly with a beach umbrella pole extending completely through the inner diameter of the hollow cylindrical stem and the threaded through coupling of the table assembly.

As further depicted in FIGS. 1, 6A, and 7, the table top 101 may further include hooks 131 positioned laterally adjacent and in between the storage compartments and the peripheral edges of the table top, and extending below a bottom surface of the table top 101. As shown, for example, in FIGS. 6A and 7, these hooks 131 may be configured to directly or indirectly receive loop portions 141 of storage pouches 140 such that storage pouches may be hung from the table top 101 when the assembly is fully assembled.

Figure 3:
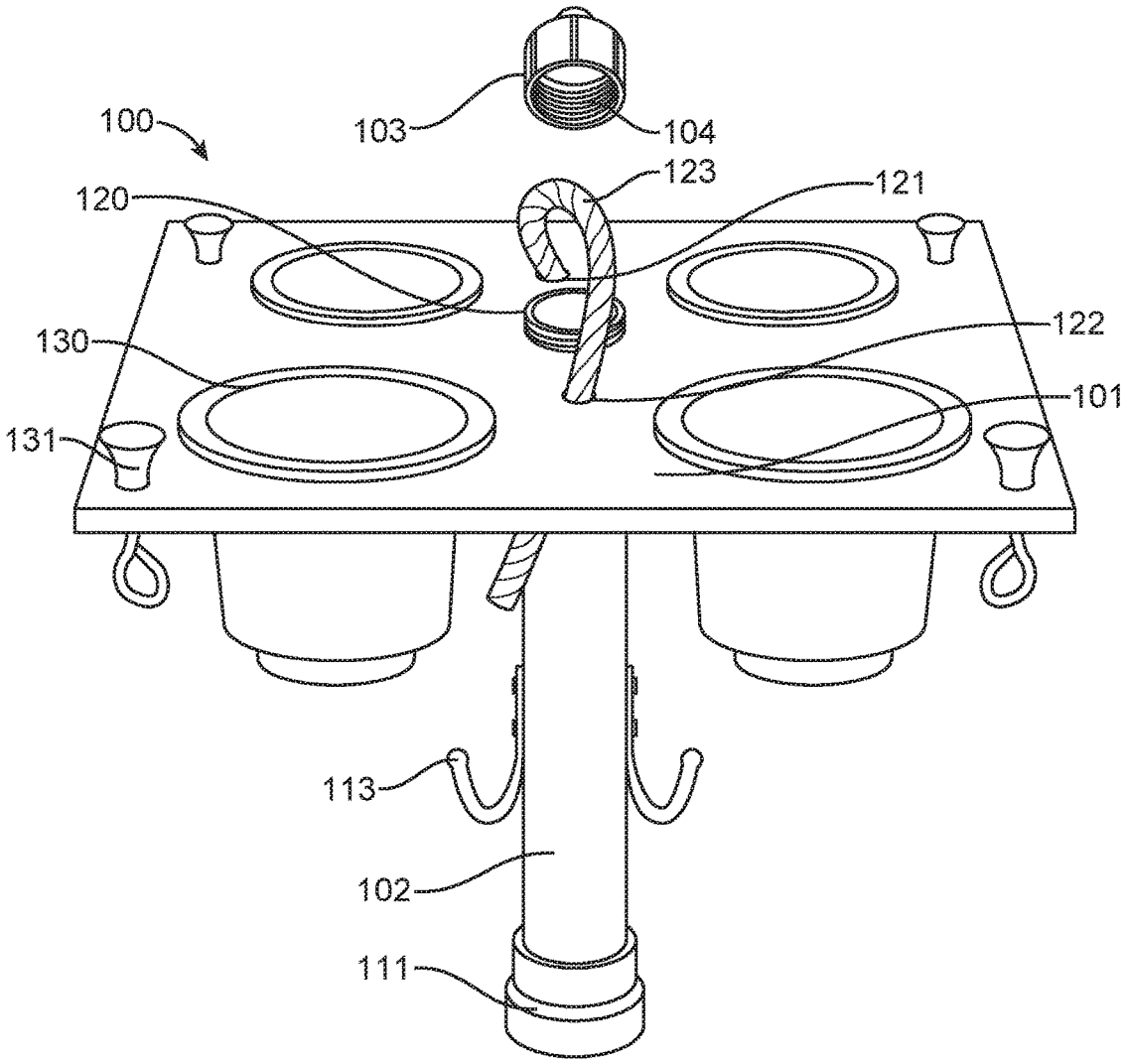
FIG. 3 is an exemplary view of the portable table assembly in which the table top is placed on the hollow cylindrical stem with the securing end cap being removed.
Figure 4:
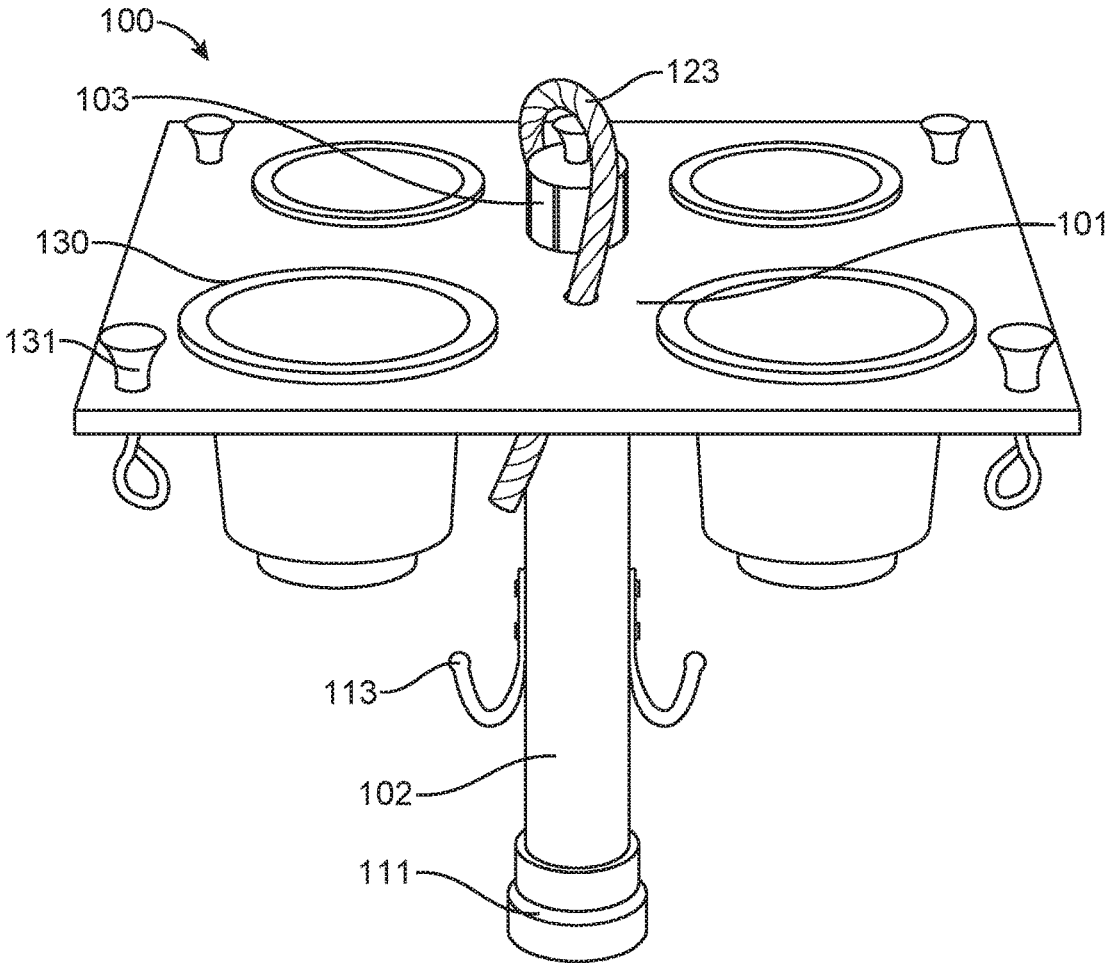
FIG. 4 is an exemplary view of the portable table assembly in which the table top is placed on the hollow cylindrical stem with the securing end cap being attached to the hollow cylindrical stem thereby securing the table top to the stem.
Figure 5:
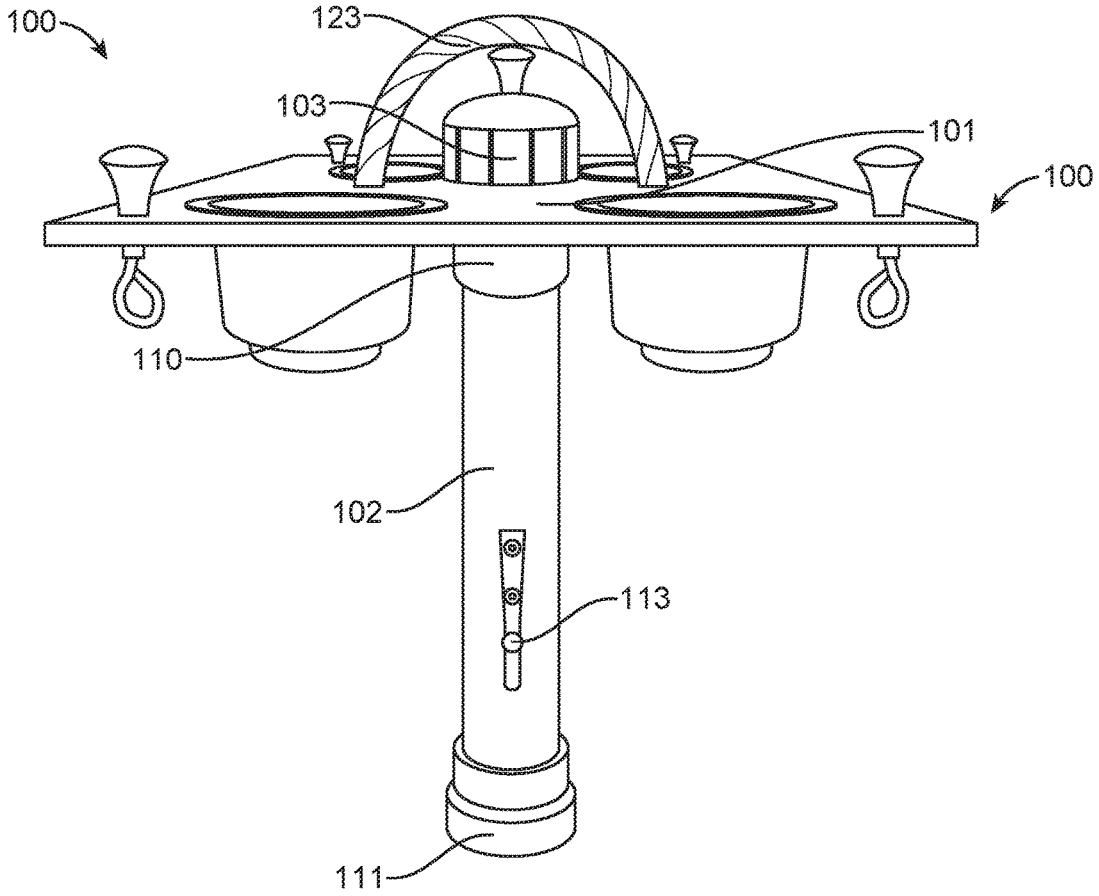
FIG. 5 is another exemplary view of the portable table assembly in which the table top is placed on the hollow cylindrical stem with the securing end cap being attached to the stem thereby securing the table top to the stem to prevent rotational movement.

FIGS. 1, 3, and 4 depict the sequential assembly of the portable table top assembly 100. Specifically, FIG. 1 depicts an exemplary view of the disassembled portable table assembly 100 in which the hollow cylindrical stem 102, table top 101, and securing end cap 103 are not in contact with one another. As shown in FIG. 3, when assembling the portable table assembly 100, the first through hole 120 of the table top is aligned with and receives the externally threaded neck 112 of the hollow cylindrical stem 102. The table top 101 seats on the annular flange 114, and as further shown in FIG. 3, portions of neck 112 (e.g., externally threaded portions) extend through through hole 120 and above the table top when the threaded portions are received through the through hole 120. Portions of the externally threaded neck 112 extending above the top surface of the table top 101 are configured to engage the securing end cap 103 (being, for example, an internally threaded 104 end cap). For example and as shown in FIGS. 3 and 4, the outer diameter of the neck may be configured for a threaded engagement with the inner diameter of the securing end cap. In this aspect, the securing end cap may be screwed onto the neck 112 thereby securing the table top to the hollow cylindrical stem 102 to prevent any axial rotation of the table top 101 relative to the hollow cylindrical stem 102. To clarify, in certain aspects, end cap 103 is internally threaded 104 and adapted to secure the table top 101 between the annular flange 114 and end cap 103 by engaging the externally threaded portions of the second end of the hollow cylindrical stem such that the table top is compressed between the annular flange and cap as the cap is advanced along the externally threaded portions of the second end in a direction towards the annular flange.

Figure 8:
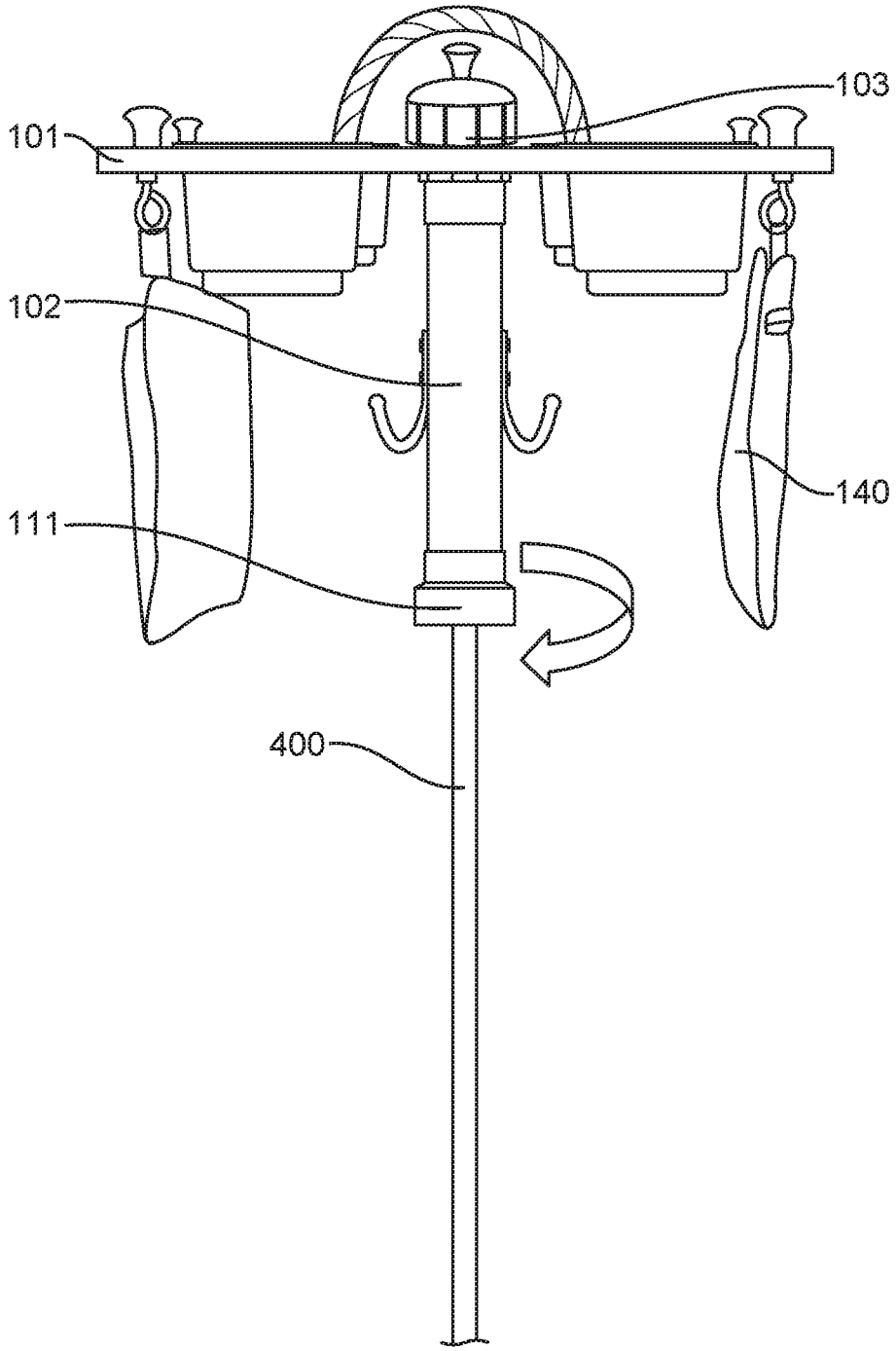
FIG. 8 is a third environmental view of the portable assembled table assembly being placed on another base member (e.g., a stake) that elevates the table assembly to a desired height.
Figure 9:
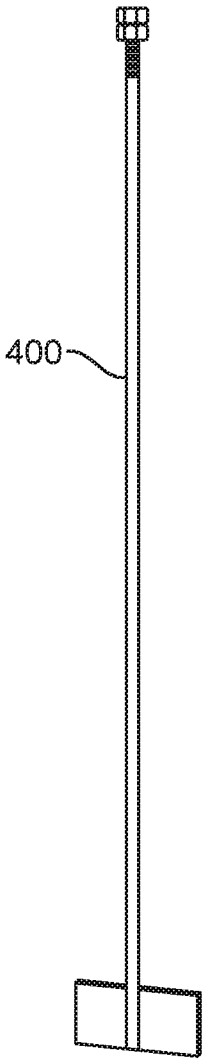
FIG. 9 depicts the base member (e.g., a stake) of FIG. 8 without the assembled table assembly being placed thereon.

As alluded to above, the assembled table top assembly 100 can be attached to numerous different bases. For example, FIG. 6A depicts base member 200 having a plurality of legs 201 radially positioned about and connected to a stem 202 of the base member that extends upward in a substantially linear, vertical direction. In preferred aspects, an end portion 203 (e.g., an annular flange) of the base member's stem 202 is configured to receive and engage (e.g., threaded engagement, snap fit, friction fit, or loosely fit over) the second end portion 111 of the hollow cylindrical stem 102. FIG. 8 shows another environmental view of the assembled table assembly (e.g., with the end cap 103 securing the table top to the hollow cylindrical stem 102) being placed on a second supporting member that elevates the table assembly. In certain aspects, the second end portion 111 can fit over base member's stem 202 and be directly adjacent to the plurality of legs 201. For example, FIG. 6B further depicts that exemplary base of FIG. 6A further including an elongate rod 204 configured to extend into the inner diameter of hollow cylindrical stem 102, and in certain instances, end portion 205 of elongate rod 204 may be adapted to contact an inner portion of securing endcap 103 when the assembled portable table assembly is placed on the base member depicted in FIG. 6B.

Figure 10A:
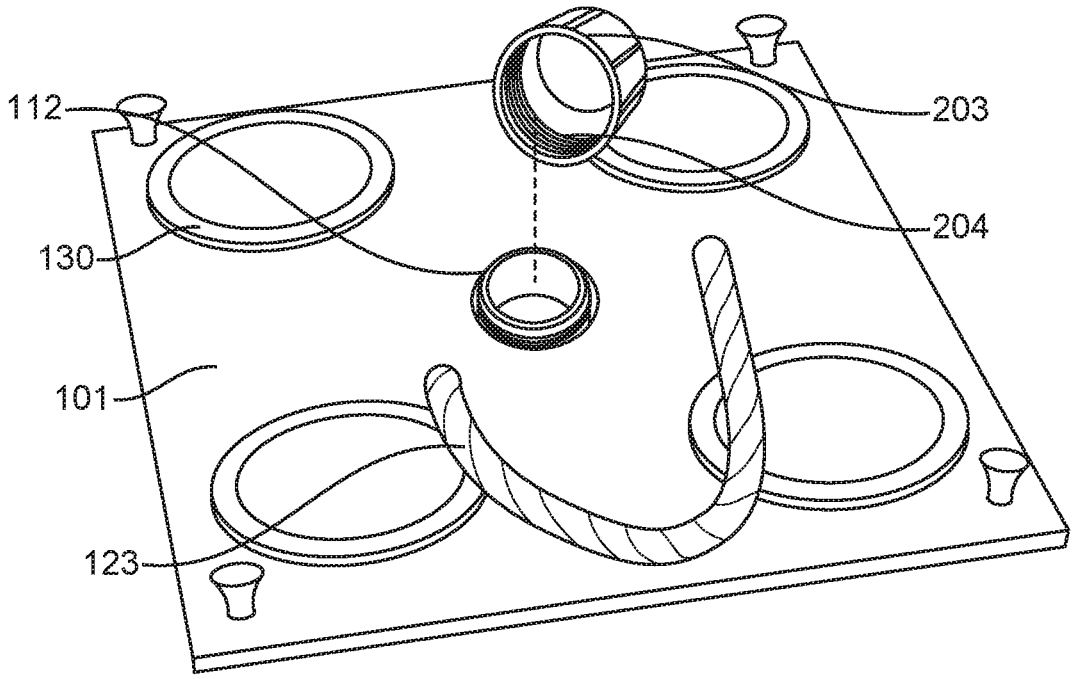
FIG. 10A depicts the threaded through coupling before engaging an end of the hollow cylindrical stem.
Figure 10B:
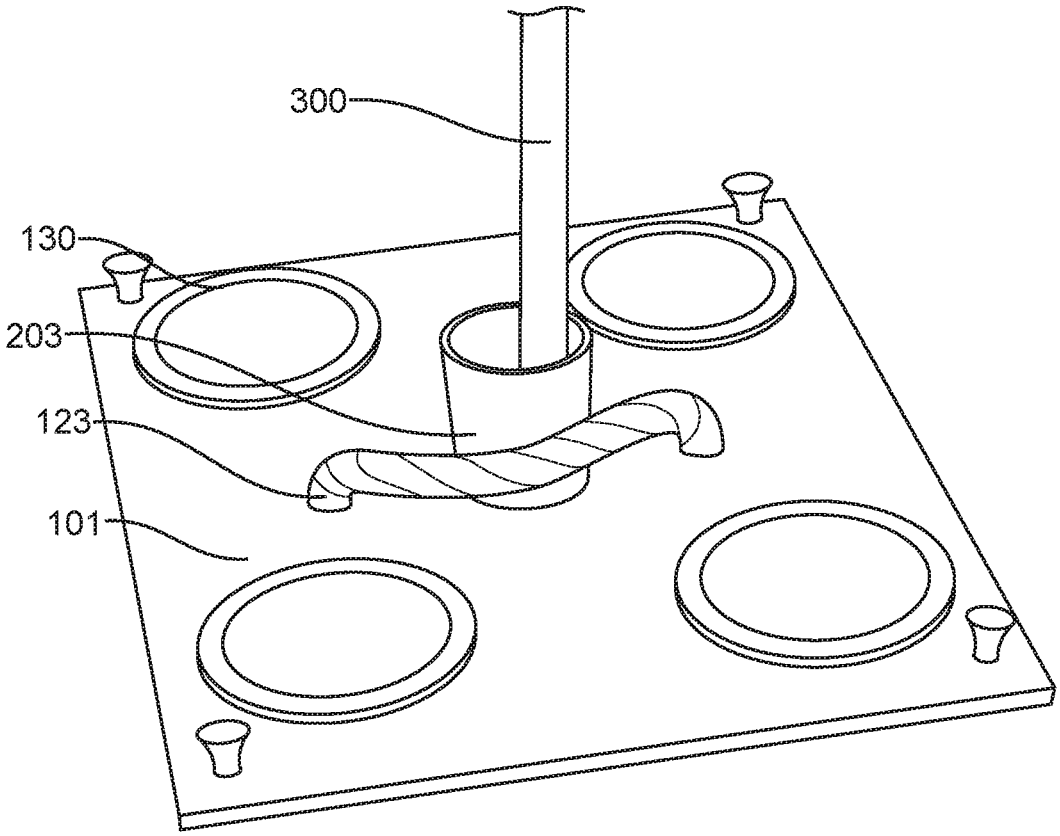

In certain aspects, the portable table assembly 100 may be used with a beach umbrella. For example, FIG. 7 shows yet another environmental view of the portable table assembly 100 in which the beach umbrella's pole 300 is received and extends completely through the inner diameter of the hollow cylindrical stem 102 and the threaded through coupling 203. For example and as further shown in FIG. 7, FIG. 10A, and FIG. 10B, when used with a beach umbrella a threaded through coupling 203 (instead of the end cap 103) may be used to secure the table top 101 to the hollow cylindrical stem 102. Threaded through coupling 203 has internal threading 204 that is complimentary to the external threading of neck 112, and threaded through coupling 203 is substantially similar to end cap 103 except threaded through cap does not include an enclosed end. Similar to end cap 103, threaded through coupling 203 is adapted to secure the table top 101 between the annular flange 114 and coupling 203 by engaging the externally threaded portions of the second end 112 of the hollow cylindrical stem such that the table top 101 is compressed between the annular flange 114 and the coupling 203 as the coupling is advanced along the externally threaded portions of the second end 112 in a direction towards the annular flange 114, As is readily apparent by the Figures, the portable table assembly 100 includes great versatility for removably attaching to and/or being placed on various suitable base structures (e.g., 200, 300, 400) thereby making it functional on essentially any type of ground surface, whether soft or hard. It is usable on uneven soft ground surfaces by utilizing any ground stake of suitable diameter, and height may be easily adjustable.

The ease with which the portable table assembly 100 may be disassembled by removing the table top 101 from the hollow cylindrical stem 102 significantly increases its utility, as it can quickly transition between different areas with different ground surface characteristics. For example, the portable table assembly 100 may be used as a stationary patio table that can be lifted off of a patio stand (e.g., a type of base member) and carried to the lawn or garden where it is placed on a ground stake (e.g., another type of base member) and used while gardening or playing lawn games. Applications for the disclosed table assembly may include, but are not limited to, patio/porch use, outdoor/lawn gaming, parks and general recreation, outdoor sporting and concert events, tailgate parties, camping, gardening, beach use (with or without a beach umbrella), and boating.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A portable table assembly comprising:

(a) a hollow cylindrical stem;

(b) a table top having an opening in a middle of the table top that is adapted to receive the hollow cylindrical stem therethrough such that the hollow cylindrical stem extends above and below the table top when inserted in the opening; and (c) a removable end cap that engages the cylindrical stem to secure the table top to the cylindrical, wherein:

the hollow cylindrical stem has spaced apart ends with a first end configured to receive a base and a second end having an annular flange and externally threaded portions adjacent to and extending vertically above the annular flange such that the table top seats on the annular flange and the externally threaded portions of the second end extend above the table top when the threaded portions are received through the opening;

the removable end cap is internally threaded and adapted to secure the table top between the annular flange and end cap by engaging the externally threaded portions of the second end of the hollow cylindrical stem such that the table top is compressed between the annular flange and cap as the cap is advanced along the externally threaded portions of the second end in a direction towards the annular flange; and the first end of the hollow cylindrical stem has a larger outer diameter than the second end of the hollow cylindrical stem.

2. The portable table assembly of claim 1, further comprising a detachable base configured for removable insertion in the first end of the hollow cylindrical stem.

3. The portable table assembly of claim 2, wherein the detachable base comprises an annular flange on which the first end of the hollow cylindrical stem rotatably seats when the base is removably inserted in the first end of the hollow cylindrical stem.

4. The portable table assembly of claim 3, further comprising a handle fixed to and extending above the table top.

5. The portable table assembly of claim 4, further comprising a plurality of removable cupholders, each removable cupholder being received through an opening formed on the table top such that each cupholder extends above and below the table top when received through the opening formed on the table top.

6. The portable table assembly of claim 5, wherein hooks are fixed to the hollow cylindrical stem between the first and second ends of the hollow cylindrical stem.

7. The portable table assembly of claim 6, further comprising a plurality of hooks attached to and extending below the table top such that each hook is positioned laterally adjacent to a corner of the table top.

8. The portable table top assembly of claim 7, further comprising a plurality of knobs, each knob is positioned above the table top and is attached to a corresponding hook extending below the table top such that each knob is axially aligned with the corresponding hook.

9. A portable table assembly comprising:

(a) a hollow cylindrical stem, the hollow cylindrical stem having spaced apart ends with a first end configured to receive a detachable base and a second end having an annular flange and externally threaded portions adjacent to and extending vertically above the annular flange such that the table top seats on the annular flange and the externally threaded portions of the second end extend above the table top when the threaded portions are received through the opening;

(b) a table top having an opening in a middle of the table top that is adapted to receive the hollow cylindrical stem therethrough such that the hollow cylindrical stem extends above and below the table top when inserted in the opening;

(c) a removable end cap that engages the cylindrical stem to secure the table top to the cylindrical stem, the removable end cap is internally threaded and adapted to secure the table top between the annular flange and end cap by engaging the externally threaded portions of the second end of the hollow cylindrical stem such that the table top is compressed between the annular flange and cap as the cap is advanced along the externally threaded portions of the second end in a direction towards the annular flange; and (d) a detachable base configured for removable insertion in the first end of the hollow cylindrical stem, wherein:

the first end of the hollow cylindrical stem has a larger outer diameter than the second end of the hollow cylindrical stem;

the detachable base comprises an annular flange on which the first end of the hollow cylindrical stem rotatably seats when the base is removably inserted in the first end of the hollow cylindrical stem;

a handle is fixed to and extends above the table top;

a plurality of removable cupholders, each removable cupholder being received through an opening formed on the table top such that each cupholder extends above and below the table top when received through the opening formed on the table top;

a plurality of hooks and knob, wherein each hook is attached to a knob via a threaded engagement, the hooks are attached to and extend below the table top such that each hook is positioned laterally adjacent to a corner of the table top and each knob is axially aligned with at least one of the plurality of hooks attached to and extending below the table top.

* * * * *